US006629375B2

(12) United States Patent
Mallsion et al.

(10) Patent No.: US 6,629,375 B2
(45) Date of Patent: Oct. 7, 2003

(54) APPARATUS FOR COLLECTING ABLATED MATERIAL

(75) Inventors: Malcolm James Mallsion, Leeds (GB); Philip John Watkiss, Leeds (GB); Susan Anne Wilkinson, Antwerp (BE)

(73) Assignee: Agfa-Gevaert (BE)

( * ) Notice: Subject to any disclaimer, the term of this patent is extended or adjusted under 35 U.S.C. 154(b) by 457 days.

(21) Appl. No.: 09/740,330

(22) Filed: Dec. 18, 2000

(65) Prior Publication Data

US 2001/0028992 A1 Oct. 11, 2001

(30) Foreign Application Priority Data

Dec. 23, 1999 (GB) ..... 9930298

(51) Int. Cl.[7] ..... F26B 17/10
(52) U.S. Cl. ..... 34/591; 34/79; 34/85
(58) Field of Search ..... 34/587, 588, 591, 34/592, 58, 79, 85, 92; 96/136, 290, 296, 299

(56) References Cited

U.S. PATENT DOCUMENTS 5,574,493 A 11/1996 Sanger et al.
5,800,679 A 9/1998 Lindström et al.
6,097,417 A * 8/2000 Richardson, Jr. et al. ... 347/225
6,308,628 B1 * 10/2001 Bronstein et al. ..... 101/467
6,371,026 B1 * 4/2002 Ben-Zion et al. ..... 101/483
6,387,156 B1 * 5/2002 Richardson, Jr. et al. ..... 95/19
6,551,383 B1 * 4/2003 Richardson, Jr. et al. ..... 95/90

FOREIGN PATENT DOCUMENTS

EP 0 882 582 B1 12/1998
GB 2 336 428 A 10/1999

OTHER PUBLICATIONS

Search report for EP 00 20 4479 dated Mar. 27, 2001.

* cited by examiner

*Primary Examiner*—Pamela Wilson
(74) *Attorney, Agent, or Firm*—Leydig, Voit & Mayer, Ltd.

(57) ABSTRACT

The invention provides an apparatus for collecting ablated material generated by exposure of an imaging layer to a source of radiation, said apparatus comprising a vacuum supply means, and a vacuum head connected to, and in close proximity with, a centrifugal separator, said vacuum head being for direct attachment to a movable mounting means having guide means. The centrifugal separator preferably comprises a reverse flow gas cyclone or a uniflow gas cyclone. The apparatus preferably also includes a filtration system capable of removing any remaining contaminants Typically, the vacuum supply means comprises a vacuum pump, the movable mounting means comprises a carriage to which the vacuum head may be attached and the guide means comprises a guide rail. A method of preparing an imaged member is also disclosed, preferably from an imaging member which comprises a lithographic printing plate precursor comprising a substrate and a metal imaging layer.

8 Claims, 4 Drawing Sheets

Figure 1:
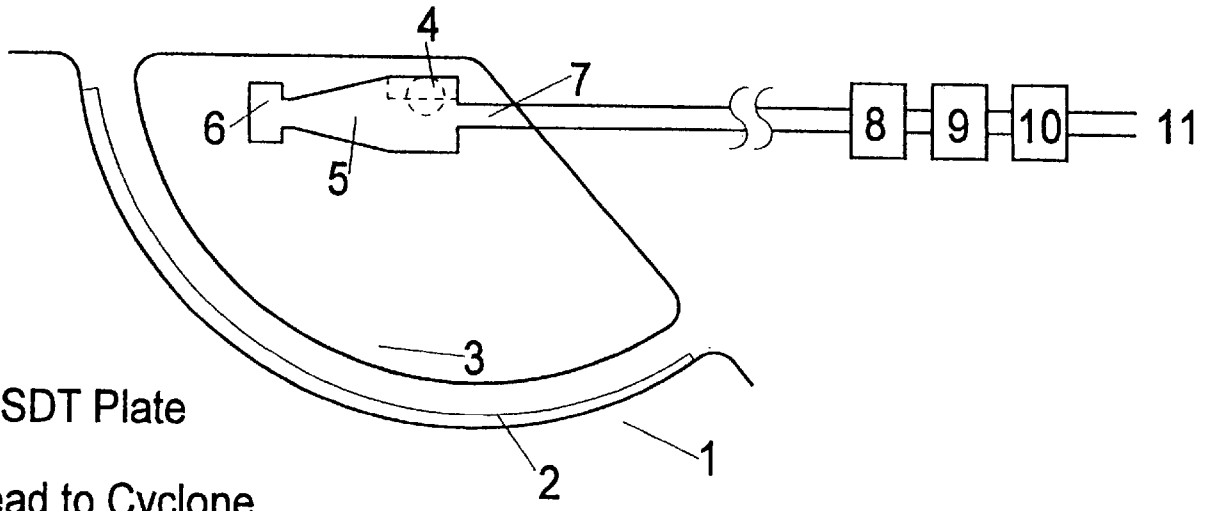

1. Plate Bed
2. Imaging Member e.g. SDT Plate
3. Vacuum Head
4. Duct from Vacuum Head to Cyclone
5. Cyclone
6. Collection Hopper
7. Cyclone Outlet Duct
8. Filter e.g. Pre-Filter, HEPA
9. Absorbent Material e.g. Silica Gel, Charcoal
10. Vacuum Pump
11. Exhaust Outlet 1. Plate Bed
2. Imaging Member e.g. SDT Plate
3. Vacuum Head
4. Duct from Vacuum Head to Cyclone
5. Cyclone
6. Collection Hopper
7. Cyclone Outlet Duct
8. Filter e.g. Pre-Filter, HEPA
9. Absorbent Material e.g. Silica Gel, Charcoal
10. Vacuum Pump
11. Exhaust Outlet A = Length of Cyclone (= B + C)
B = 1.5 D
C = 2.5 D
D = Diameter of Cyclone
E = Diameter of Exit to Collection Hopper (arb. about = D/4)
F = Length of Air Inlet to Cyclone (= D/2)
G = Width of Air Inlet Duct to Cyclone ( = 0.2D)
H = Diameter of Air Inlet Duct
I = Diameter of exhaust Duct of Cyclone (= D/2)
J = Location of Seam A = Length of Cyclone
B = Length of Cyclone to Tip of Exit Duct
C = Length of Exhaust Duct of Cyclone
D = Diameter of Cyclone
E = Diameter of Exhaust Duct of Cyclone
F = D/2 - E/2
G = Width of Air Inlet Duct
H = Diameter of Air Inlet Duct
I = Length of Air Inlet to Cyclone (= D/2)

APPARATUS FOR COLLECTING ABLATED MATERIAL

This invention relates to the formation of images directly from electronically composed digital sources. More particularly, the invention is concerned with imaging methods wherein particles of an imaging layer are ablatively removed from an imaging member during exposure of the member to imaging radiation. Such methods are especially applicable, for example, to the preparation of lithographic printing plates.

Lithographic printing is a process of printing from surfaces which have been prepared in such a way that certain areas are capable of accepting ink (oleophilic areas), whereas other areas will not accept ink (oleophobic areas). The oleophilic areas form the printing areas while the oleophobic areas form the background areas.

Plates for use in lithographic printing processes may be prepared using a photographic material that is made imagewise receptive or repellent to ink upon photo-exposure of the photographic material and subsequent chemical treatment. However, this method of preparation, which is based on photographic processing techniques, involves several steps, and therefore requires a considerable amount of time, effort and expense.

Consequently it has, for many years, been a long term aim in the printing industry to form images directly from an electronically composed digital database, ie by a so-called "computer-to-plate" system. The advantages of such a system over the traditional methods of making printing plates are:

(i) the elimination of costly intermediate silver film and processing chemicals;
(ii) a saving of time; and
(iii) the ability to automate the system with consequent reduction in labour costs.

The introduction of laser technology provided the first opportunity to form an image directly on a printing plate precursor by scanning a laser beam across the surface of the precursor and modulating the beam so as to effectively turn it on and off. In this way, radiation sensitive plates comprising a high sensitivity polymer coating have been exposed to laser beams produced by water cooled UV argon-ion lasers and electrophotographic plates having sensitivities stretching into the visible spectral region have been successfully exposed using low powered air-cooled argon-ion, helium-neon and semiconductor laser devices.

A digital imaging technique has been described in U.S. Pat. No. 4,911,075 whereby a so-called driographic plate which does not require dampening with an aqueous fountain solution to wet the non-image areas during printing is produced by means of a spark discharge. In this case, a plate precursor comprising an ink-repellent coating containing electrically conductive particles coated on a conductive substrate is used and the coating is ablatively removed from the substrate. Unfortunately, however, the ablative spark discharge provides images having relatively poor resolution.

It is known that this feature may be improved by the use of lasers to obtain high resolution ablation as described, for example, by P E Dyer in "Laser Ablation of Polymers" (Chapter 14 of "Photochemical Processing of Electronic Materials", Academic Press, 1992, p359–385). Until recently, imaging via this method generally involved the use of high power carbon dioxide or excimer lasers. Unfortunately, such lasers are not well-suited to printing applications because of their high power consumption and excessive cost, and the requirement for high pressure gas handling systems. Recent developments have, however, led to the availability of more suitable infra-red diode lasers, which are compact, highly efficient and very economical solid state devices. High power versions of such lasers, which are capable of delivering up to 3000 mJ/cm$^2$, are now commercially available.

Coatings which may be imaged by means of ablation with infra-red radiation have previously been proposed. Thus, for example, a proofing film in which an image is formed by imagewise ablation of a coloured layer on to a receiver sheet is described in PCT Application No 90/12342. European Patent No 649374 describes an ablation technique wherein a driographic printing plate precursor is imaged digitally by means of an infra-red diode laser or a YAG laser, and the image is formed directly through the elimination of unwanted material. A heat mode recording material is disclosed in U.S. Pat. No. 4,034,183 which comprises an anodised aluminium support coated with a hydrophilic layer. On imagewise exposure using a laser, the exposed areas are rendered hydrophobic, and thereby accept ink.

Japanese patent application laid open to public inspection No 49-117102 (1974) discloses a method for producing printing plates wherein a metal is incorporated in the imaging layer of a printing plate precursor which is imaged by irradiation with a laser beam modulated by electric signals. Typically, the plate precursor comprises a metal base, such as aluminium, coated with a resin film, which is typically nitrocellulose, and on top of which has been provided a thin layer of copper. The resin and metal layers are removed in the laser-struck areas, thereby producing a printing plate. The disadvantage of this system, however, is that two types of laser beam irradiation are required in order to remove firstly the copper (eg by means of an argon-ion laser) and then the resin (eg with a carbon dioxide laser); hence, the necessary equipment is expensive.

Subsequently a method of printing plate production which obviated the requirement for a second laser exposure was disclosed in Japanese patent application laid open to public inspection No 52-37104 (1977). Thus, a printing plate precursor comprising a support, typically aluminium, an anodic aluminium oxide layer, and a layer of brass, silver, graphite or, preferably, copper is exposed to a laser beam of high energy density in order to render the exposed areas hydrophilic to yield a printing plate. The printing plate precursor is, however, of rather low sensitivity and requires the use of a high energy laser for exposure.

An alternative heat mode recording material for making a lithographic printing plate is disclosed in European Patent No 609941, which comprises a support having a hydrophilic surface, or provided with a hydrophilic layer, on which is coated a metallic layer, on top of which is a hydrophobic layer having a thickness of less than 50 nm. A lithographic printing plate may be produced from the said material by imagewise exposing to actinic radiation, thereby rendering the exposed areas hydrophilic and repellent to greasy ink.

Conversely, European Patent No 628409 discloses a heat mode recording material for making a lithographic printing plate which comprises a support and a metallic layer, on top of which is provided a hydrophilic layer having a thickness of less than 50 nm. A lithographic printing plate is produced by imagewise exposing the material to actinic radiation in order to render the exposed areas hydrophobic and receptive to greasy ink.

Subsequently, PCT Patent Applications Nos WO 98/55307-WO 98/55311 and WO 98/55330-WO 98/55332 have disclosed lithographic printing plate precursors comprising a grained and anodised aluminium substrate having coated thereon a metallic layer, typically a metallic silver layer. The precursors may be directly imaged to selectively remove the metallic layer by ablation in the radiation struck (non-image) areas, thereby revealing the hydrophilic anodised aluminium layer in these areas and leaving the hydrophobic metallic image in the non-radiation-struck (image) areas.

Thus, whilst it is well known to form an image on a substrate by ablation of a given material from the substrate, each of the foregoing imaging methods suffers from the difficulties associated with the generation of airborne particles by ablation of material from the substrate. Laser exposure of infra-red laser dye ablation systems at the wavelength at which the dye absorbs, for example, will lead to ablation of the dye recording layer from the substrate, whilst metallic layers may be ablated by exposure to radiation at a wavelength which is absorbed by the layer and converted to thermal energy, which then heats the metal layer to its melting point and causes high pressure blow-off of the irradiated material in the form of small droplets.

In either of these cases—indeed, in any ablative system—therefore, there remains the problem of the ablated imaging layer, which is removed as a plume of smoke and debris. It is possible for the generated debris to deposit, for example, on the optics or internal surfaces of the imaging apparatus, or on the printing plate itself. The collection of such debris on the optics would result in a reduction in the energy which the imaging device was able to deliver to the ablation medium, which could potentially give rise to underexposure and loss of image quality. Furthermore, the airborne ablated particles and fumes are likely to give rise to various environmental issues and health and safety hazards. It is clearly necessary to provide means by which such ablation debris may be satisfactorily controlled.

Several means for the collection of ablation debris are already known from the published literature. Typically, extraction apparatus is provided which comprises a vacuum head for collection of the ablated debris at the point at which it is generated, and a length of ducting to transport the collected debris from the vacuum head to a gas-particle separator device that removes and collects the ablated particles from the effluent gas. However, such apparatus generally suffers from problems associated with the deposition of collected debris, which can severely impair efficiency, and the incorporation of additional, remedial, features is often necessary in order to alleviate these difficulties.

Thus, for example, U.S. Pat. No. 5,574,493 discloses a complex method by which plugging of the extraction line may be avoided, particularly in the vicinity of the vacuum chamber. However, regular cleaning is required in order to maintain the efficient operation of the extraction system. Furthermore, the electrostatic precipitator and carbon black filter used to separate the ablated particles from the effluent gas is located some distance away from the source of generation of the ablated debris; the filtration housing is connected to the vacuum head by means of a length of ducting which is itself susceptible to a deleterious build-up of dust along the length of its walls.

A filter housing which is some way remote from the point of generation of ablated debris is also described in European Patent EP-A-882582, and the disclosed apparatus also suffers from dust collection in the length of tubing which connects the vacuum head to the said housing, such drawbacks being commonly encountered in apparatus which is designed in this way. Hence, complex and cumbersome maintenance regimes are necessary in order to ensure the continued satisfactory operation of such systems.

It is an objective of the present invention to provide an effective means of collection of debris which is generated during imaging operations, which method enables said debris to be removed from the effluent gas and thereby prevents the deposition of the said debris on the optics or internal surfaces of the imaging apparatus, or on the imaged member.

It is a further objective of the present invention to provide said collection means, whilst at the same time overcoming the problems of dust collection associated with prior art methods, wherein regular inconvenient and cumbersome maintenance and cleaning techniques are required to be implemented in order to ensure that pipework remains substantially free from contamination.

It is a still further objective of the present invention to provide a method of producing an imaged member, said method allowing the ablated materials which are formed during exposure to be efficiently collected and removed without presenting a hazard to the user or the environment. Said imaged member may comprise, for example, an imaged film or plate, but is preferably a lithographic printing plate.

According to a first aspect of the present invention there is provided an apparatus for collecting ablated material generated by exposure of an imaging layer to a source of radiation, said apparatus comprising a vacuum supply means, and a vacuum head connected to, and in close proximity with, a centrifugal separator, said vacuum head being for direct attachment to a movable mounting means having guide means.

Said centrifugal separator is preferably a gas-solid separator that uses centrifugal forces to separate solid particles from the transport gas. In view of the 'sticky' nature of the ablation debris, the separator, typically known as a 'gas cyclone', is optimally located in close proximity to the source of ablation debris generation, in order to prevent the particles from impinging and sticking to the internal walls of the duct work which transports the debris to the separator.

Said separator, which is utilised to separate, remove and collect the ablation debris carried by the exhaust fumes emitted from the vacuum head, may be of reverse or uniflow design. Typically, gas cyclones are based on the reverse cyclone design, wherein the gas enters the cyclone chamber tangentially and is propelled in a spiral to the apex at the bottom of a cone shaped chamber. The gas flow then reverses upon itself and moves to the exit at the opposite (top) end of the chamber, and generally then by way of a second, smaller diameter, cyclone to an outlet pipe or duct. The solids in the gas stream are propelled towards the walls of the cyclone chamber and fall down towards a collection pot.

In the case of a uniflow gas cyclone, the gas again enters the cyclone chamber tangentially and is again propelled in a spiral along the length of the cyclone chamber to the bottom of the chamber. However, said gas then exits the chamber by way of a central vertical outlet pipe or duct located at the bottom of said chamber. Again, the solids in the gas stream are projected towards the walls of the cyclone chamber and fall down to the collection area surrounding the exit pipe or duct.

In either case, cyclone efficiency is increased by ensuring that all internal surfaces are degreased and polished and uneven surfaces, such as those created at pipework joints or junctions, are smoothed to the greatest extent possible. In this way, air flow efficiency is increased, thereby ensuring that a higher proportion of the debris is carried to the collection pot, rather than adhering to the walls of the apparatus. Optionally, non-stick coatings may be applied to internal surfaces in order to further enhance this effect; suitable materials for such coatings include, for example, polytetrafluoroethylene and novolak resins. Alternative means which may be employed in order to alleviate problems associated with adhesion of debris to internal walls include the use of disposable liners for the cyclone; it is also envisaged that the incorporation of low-cost, disposable cyclones may offer an economically attractive option in this regard.

The gas outlet in each case may be vented to the atmosphere, but is preferably fitted with a filtration system which is capable of removing any remaining toxic materials or other contaminants, at least to the extent that said materials in the gas flow are reduced to a level below occupational health limits. In this event, venting to the outside atmosphere is not a necessary requirement and remaining gases may be conveniently vented to the internal environment.

The vacuum supply means conveniently comprises a vacuum pump, which may be of any typically commercially available design, but must be of such efficiency that the bulk of the ablation debris is collected by the extraction head during imaging, and high efficiency of gas-solid separation is subsequently achieved in the separator chamber.

The movable mounting means preferably comprises a carriage to which the vacuum head may be attached. Said movable mounting means typically also supports the radiation source which is utilised for imaging the imaging member. The movable mounting means is associated with guide means which define the path along which said mounting means may travel. Typically, said guide means may comprise a guide rail.

It is a preferred feature of the apparatus of the present invention that said gas cyclone should be located in close proximity to the vacuum head in order to avoid the disadvantages of prior art systems, wherein lengthy sections of pipework, tubing or ducting were employed to interconnect the vacuum head with the remote debris collection device, and unwanted dust collection in said sections of pipework, tubing or ducting necessitated excessive maintenance of the systems. Thus, the cyclone is preferably located directly on the movable mounting means, although in such cases the additional weight of the chamber, and its increasing weight following debris collection during imaging, needs to be allowed for in the design of the movable mounting means and the guide means. Alternatively, the cyclone may be located in the vicinity of the movable mounting means, but supported by a separate second mounting means, and guided in close configuration to the first mounting means by a second guide means, typically a second guide rail. In a further embodiment, the cyclone may be placed in a fixed position close to the extraction head, and upstream of any further extraction devices, such as filters or absorbents.

Improved efficiency of debris removal may be achieved by the incorporation of a commercially available high efficiency particulate air filter (HEPA filter), which contains 99.97% of particles having a diameter of 0.3 $\mu$m or less, in the apparatus. Advantageously, said filter may be located downstream of the centrifugal gas-solid separating device, connected to said device by means of at least one section of pipework, ducting or tubing, and located in a position between said device and the vacuum supply means such that remaining traces of debris may be conveniently collected.

It is found that, in general terms, efficiency of debris removal is improved by increasing the particle size of the material to be collected and, in this regard, the use of baffle arrangements within the pipework has been found to provide advantageous results, increasing the number of collisions between particles which, in view of their sticky nature previously referred to, tend to adhere to one another as a consequence. Advantageously, said baffle arrangement is located between the vacuum head and the centrifugal separator, thus allowing for increased debris collection in the said separator.

Preferably, the apparatus according to the present invention additionally includes an absorbent filter, capable of removing residual odours and very fine particles from the exhaust gases. Said absorbent filter is primarily designed to remove odours associated with volatile organic compounds, and comprises a suitable absorbent material such as activated charcoal, molecular sieves or silica gel granules. Suitable molecular sieves would be, for example, UOP Type 4A, comprising potassium aluminium silicate, whilst silica gel granules having an internal surface area of 500–800 $m^2/g$ provide particularly favourable results. The absorbent filter may be conveniently located downstream of the centrifugal gas-solid separating device, and of the HEPA filter, if this is present, in a position between these devices and the vacuum supply means; alternatively, said filter may be located downstream of the vacuum supply means, in a position between said means and the exhaust gas outlet.

Particularly advantageous results have been achieved when employing absorbent filters in apparatus according to the present invention when such apparatus has been used for the processing of imaging members incorporating metal imaging layers; thus, the unpleasant odours associated with the ablation of very fine metal particles, which occurs on exposure of the said layers to radiation, may be eliminated by the incorporation of a suitable absorbent filter. Specifically, the odours resulting from the ablation of submicron silver particles have been successfully eliminated by the use of an absorbent filter in an apparatus according to the invention when exposing samples of the Howson® Silverlith® SDT plate, supplied by Agfa-Gevaert Limited.

The radiation source utilised in conjunction with the apparatus of the present invention generally comprises an imagesetter or platesetter, which device may have either an external drum or an internal drum configuration. In general, photographic film is most suitably imaged by exposure in an imagesetter, whilst a platesetter is preferably employed for the preparation of a lithographic printing plate from a radiation sensitive precursor.

The apparatus of the present invention is most preferably used in conjunction with the imaging of lithographic printing plate precursors comprising a substrate and a metal imaging layer. The substrate may be, for example, a metal or plastic substrate, but is preferably an aluminium substrate which has been electrochemically grained and anodised on at least one surface in order to enhance its lithographic properties. Optionally, the aluminium may be laminated to other materials, typically various plastics materials.

The metallic layer, which is applied to the substrate, such as grained and anodised aluminium, may comprise any of several metals, specific examples of which include copper, bismuth and brass. Most preferably, however, the metallic layer comprises a silver layer. The thickness of the metallic layer is preferably from 1 nm to 100 nm, most preferably from 10 nm to 50 nm. The layer may be applied to the substrate by any of various techniques, including vapour or vacuum deposition or sputtering. In the case of a silver layer, however, the layer is most preferably applied by the treatment of a silver halide photographic material according to the silver salt diffusion transfer process.

Optionally, the lithographic printing plate precursor may also include a further layer, coated on top of the metallic layer, and which is ablated at the same time as the metallic layer. The presence of such a layer results in the production of debris having increased particle size when the precursor is imaged and ablation takes place. As previously discussed, the greater particle size results in increased efficiency of debris collection. Suitable materials for forming the further layer include, for example, novolak resins, epoxides, (meth) acrylate polymers, cellulosic polymers, poly(vinyl acetate) and related polymers and poly(vinyl pyrrolidone). The particle size of the ablated metallic layer and topcoat in such a case will be determined not only by the nature of the topcoat material, but also by other parameters such as the thickness of the topcoat.

Alternative means of providing particles of debris having greater size involve changes to the substrate, which may be achieved, for example, by alteration of the conditions employed during graining and anodising, thereby providing a substrate having a different degree of surface roughness, anodic weight, or other parameter. A post-anodic treatment may also be incorporated, wherein a further layer is applied over the anodic surface of the substrate prior to application of the metallic layer. Said further layer may comprise, for example, a polymeric material such as poly(acrylic acid) or poly(vinyl phosphonic) acid, or a copolymer thereof, or a metal complex salt, such as an alkali metal hexafluorozirconate or hexafluorotitanate.

According to a second aspect of the present invention, there is provided a method of preparing an imaged member, said method comprising:

a) providing an imaging member comprising a substrate and an ablatively removable imaging layer;
b) imagewise exposing said imaging member to ablatively remove exposed areas of the imaging layer; and
c) utilising an apparatus according to the first aspect of the invention to collect ablated material.

Said method is most preferably applied to the preparation of lithographic printing plates, most preferably those comprising a grained and anodised aluminium substrate and an ablatable metallic silver layer. In such cases, the precursor is imaged by a beam of radiation, preferably from a laser operating in the infra-red region of the spectrum. Examples of suitable infra-red lasers include semiconductor lasers and YAG lasers, for example the Agfa Galileo Thermal T or Gerber Crescent 42T Platesetters with a 10 W YAG laser outputting at 1064 nm. Exposure to the beam of radiation causes ablation of the silver layer to occur in the radiation-struck areas.

Following exposure and removal of the ablated debris, the plate may optionally be prepared for printing operations by treatment with a composition comprising a silver oleophilising agent, a desensitising compound, and optionally a proteolytic enzyme, in order to ensure good ink acceptance in image areas and a high degree of hydrophilicity in background areas, thus enabling a good start-up on press to be achieved. However, certain imaging members may not require said treatment, in which case it is possible to transfer the imaged member directly to a press and commence printing operations, without any form of post-exposure operation.

The method of the present invention enables press ready plates to be prepared without the requirement for the use of costly intermediate film and developer chemistry and the attendant inconvenience resulting from the use of these materials, and in a safe and convenient manner, eliminating the requirement for regular maintenance of apparatus to remove ablated debris, and without hazard to the user or the environment. The plates which are obtained show high image quality, good press properties and high durability on press.

The invention will now be illustrated, though without limitation, by reference to the attached drawings, in which:

FIG. 1 shows a front view of an apparatus according to the present invention, used for collecting ablation debris generated on imagewise laser exposure of an imaging member by means of an imaging device having an internal drum configuration.

Figure 2:
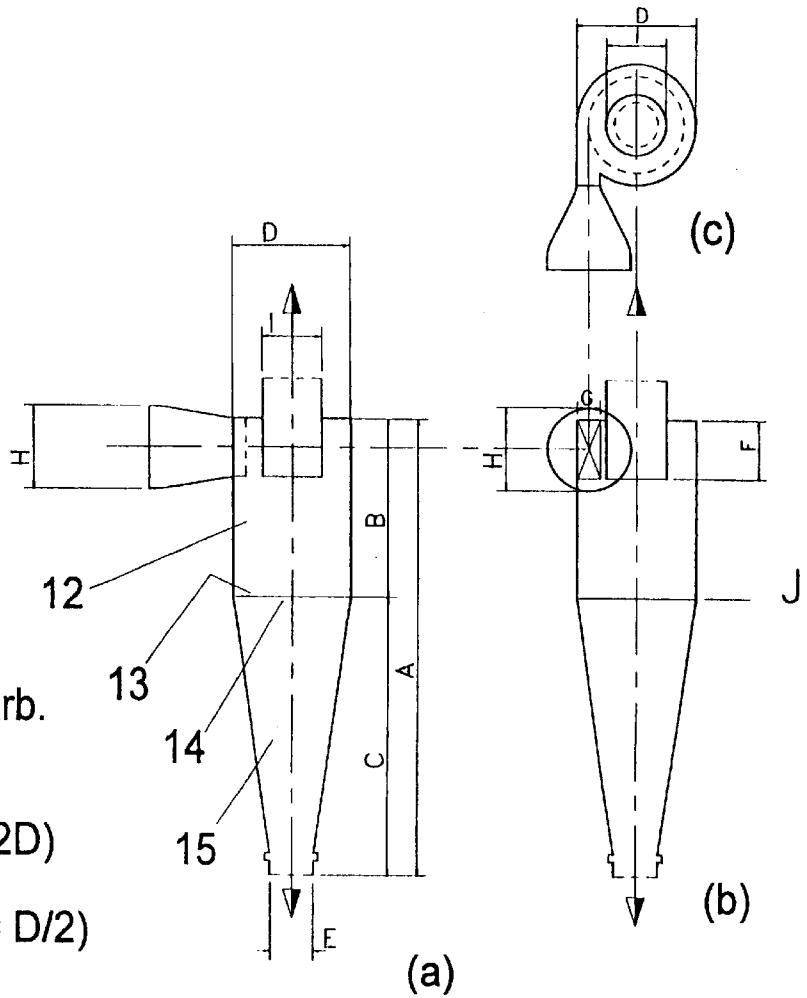

FIGS. 2(*a*)–(*c*) show, respectively, front elevation, side elevation and end elevation views of a reverse flow gas cyclone, useful for the collection, according to the method of the present invention, of ablated debris generated on imagewise laser exposure of an imaging member.

Figure 3:
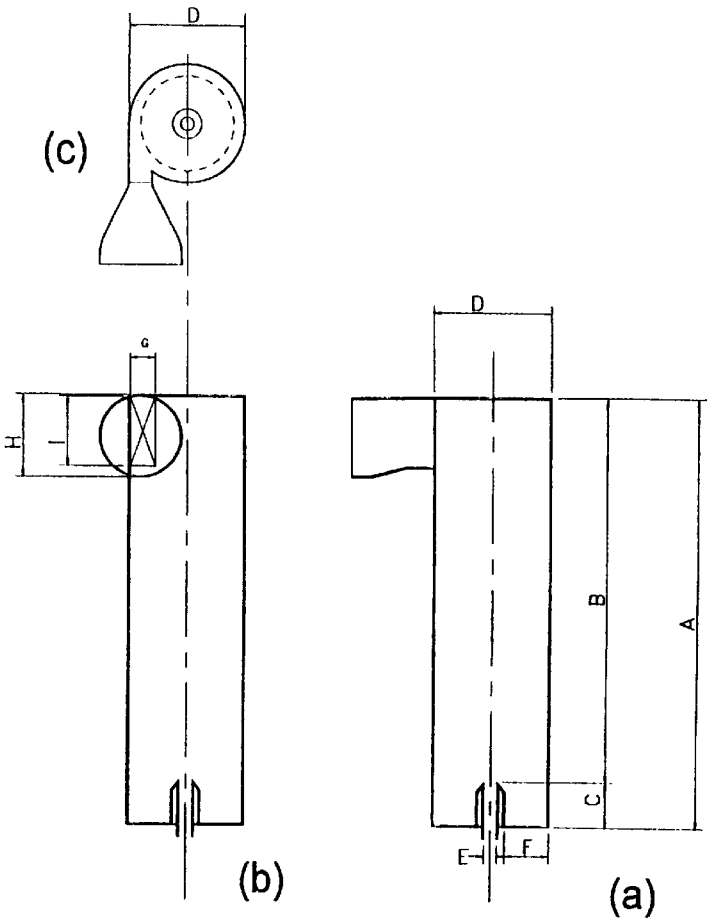

FIGS. 3(*a*)–(*c*) show, respectively, front elevation, side elevation and end elevation views of a uniflow gas cyclone, useful for the collection, according to the method of the present invention, of ablated debris generated on imagewise laser exposure of an imaging member.

Figure 4:
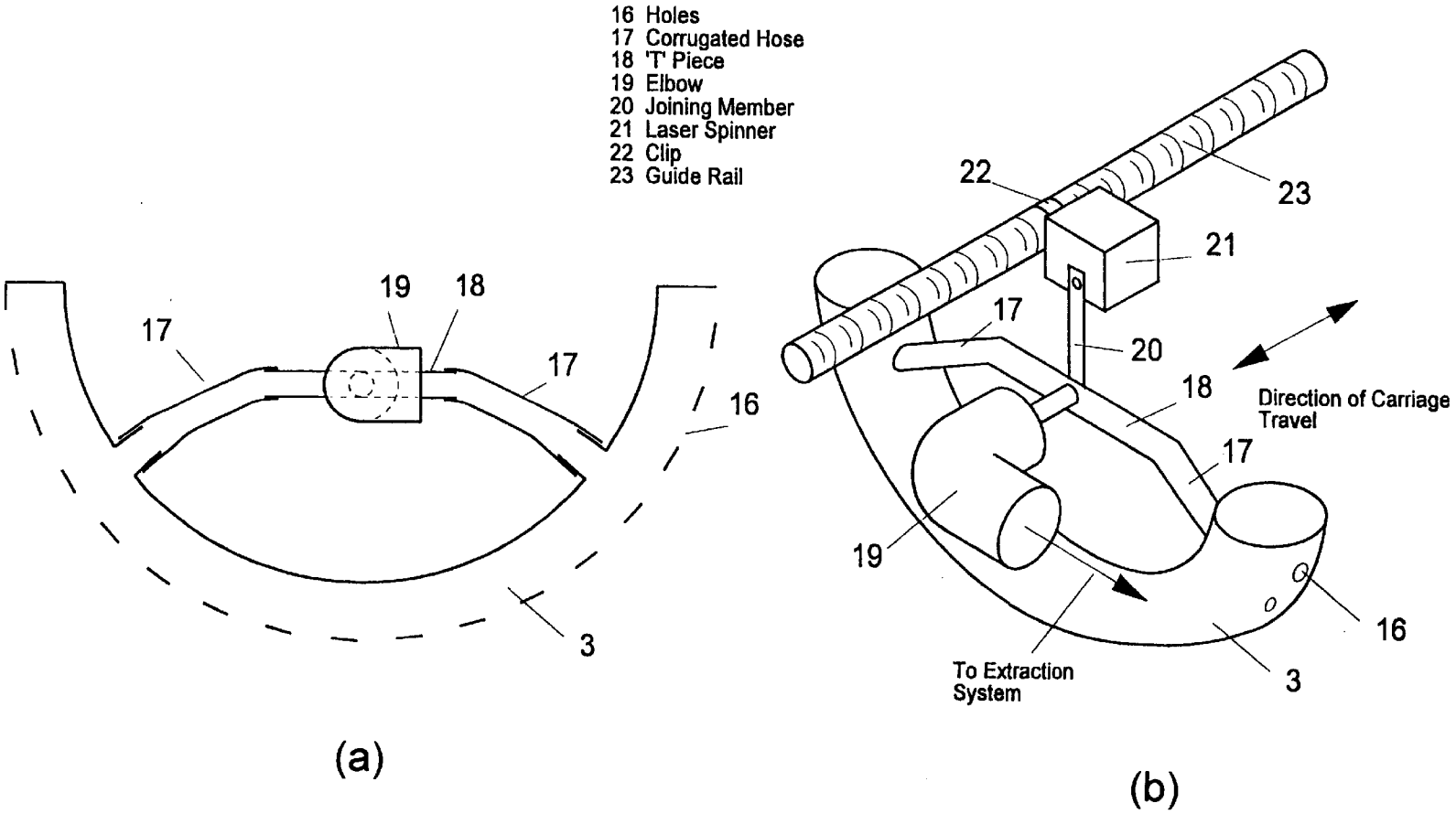

FIGS. 4(*a*)–(*b*) show, respectively, side elevation and isometric views of a vacuum head, as employed in the apparatus of the present invention, illustrating its relationship to the carriage and guide rail with which it is associated.

In operation, the apparatus according to the present invention may be employed in combination with various imaging devices as detailed above, but is particularly suitable for use in combination with an imagesetter or platesetter which may be of either internal or external drum configuration.

Thus, referring to FIG. 1, there is shown an imaging member 2 including an ablatable imaging layer, said imaging member being mounted to the plate bed 1 of an internal drum platesetter. Typically, said imaging member may comprise a lithographic printing plate based on metal ablation technology, such as the Silverlith® SDT plate produced by Agfa-Gevaert Ltd., which comprises an ablatable silver layer coated on a grained and anodised aluminium substrate. Imaging of such a member occurs when the metal surface is struck by an IR laser beam of sufficient energy and power density, and for a sufficiently lengthy duration, to cause heating and melting of the metal layer prior to its expulsion from the plate surface.

The ablation debris which is generated on imaging the imaging member 2 is picked up by the vacuum head 3, from whence it passes to the duct 4, which causes the debris to be directed tangentially into the gas cyclone 5. As a consequence of the action of the cyclone, particles having a diameter of greater than about 5 $\mu$m are thrown outwards against the cylindrical wall of the vessel, collecting thereafter in a hopper 6 at the base of the cyclone. On the other hand, debris particles having a diameter less than about 5 $\mu$m, which is the case with ablated material from the Silverlith® SDT plate, collect by impacting on the internal walls of the cyclone chamber. It is found that most of the ablation debris is thereby collected by means of the operation of the cyclone 5. In any event, improved efficiency of collection of particles of diameter less than 5 $\mu$m may be achieved by employing a cyclone of reduced diameter.

Some debris may, however, remain following the passage of the airstream through the cyclone and, for this purpose, the apparatus of the present invention preferably also includes a section of ducting 7 connecting said cyclone to, in sequence, HEPA filter 8, absorbent filter material 9 and vacuum pump 10, the airstream thereafter being vented to the atmosphere via exhaust gas outlet 11. As an alternative, the vacuum pump 10 may be located between the HEPA filter 8 and the absorbent filter material 9.

The cyclone 5 used for the purposes of the present invention is generally constructed from a metal, such as die cast aluminium or steel plate or, more preferably, from a lightweight plastics material, typically poly(vinyl chloride). Additionally, said cyclone may be constructed such that it comprises a single element or, more preferably, it may comprise two elements; the latter arrangement has the advantage that it provides for improved ease of cleaning and re-use.

Thus, the reverse flow cyclone shown in FIGS. 2(*a*)–(*c*) comprises a first section 12 which includes a seam 13 which abuts the seam 14 of a second section 15, thereby forming a seamless join. FIG. 2(*a*) shows the cyclone as having length A, which comprises the sum of the length B of the top chamber and the length C of the conical section. The diameter D of the cyclone is chosen such that B=1.5D and C=2.5D. The exit to the collection hopper, via the apex at the base of the cyclone, is an outlet of diameter E. Referring now to FIGS. 2(*b*) and 2(*c*), the cyclone includes an air inlet of length F and width G, such that F=0.5D and G=0.2D, said inlet being connected to an optionally fluted duct having maximum diameter H at its end remote from the cyclone. The cyclone also includes an exhaust duct of diameter I, where I=0.5D, said exhaust duct being located at the top of the cyclone.

The uniflow gas cyclone illustrated in FIGS. 3(*a*)–(*c*) comprises a single section cyclone which, as shown in FIG. 3(*a*), has overall length A and diameter D and includes an exhaust duct having length C and diameter E and an air inlet of length I and width G, such that I=0.5D, said inlet being connected to an optionally fluted duct having maximum diameter H at its end remote from the cyclone.

In any event, the particular dimensions of an individual gas cyclone to be fitted, via a gas outlet, to a particular extraction system in close proximity with the vacuum head will, to a large extent, be dictated by the overall dimensions of the system and, in particular, the amount of space available within the imaging device. An additional factor in determining size requirements relates to the air speed of the ablation debris collected by the vacuum head and subsequently exhausted into the cyclone tangentially; this necessitates an inlet velocity to the cyclone device of at least 5 m/s, and preferably between 20 and 50 m/s.

Hence, the dimensions of the reverse flow cyclone of FIGS. 2(*a*)–(*c*), designated A–I, preferably fall within the following limitations:

A=80–700 mm; B=30–300 mm; C=50–500 mm; D=20–200 mm; E=5–80 mm; F=10–100 mm; G=4–40 mm; H=10–150 mm; I=10–100 mm.

Similarly, the preferred ranges of the dimensions of the uniflow gas cyclone shown in FIGS. 3(*a*)–(*c*), designated A–I, are as follows:

A=80–700 mm; B=60–500 mm; C=5–200 mm; D=20–200 mm; E=6–50 mm; F=4–100 mm; G=4–40 mm; H=10–150 mm; I=10–100 mm.

Referring, finally, to FIGS. 4(*a*) and (*b*), it is seen that the vacuum head 3, which includes a multiplicity of holes 16 in a single line around its circumference, is attached by way of sections of hose 17 to a 'T' piece 18 which, in turn, is linked to an elbow piece 19 which leads to ducting and the cyclone. The 'T' piece 18 is also attached via the joining member 20 to a laser spinner 21, which forms part of the optical exposure system and is itself attached, via clip 22, to a guide rail 23. Thus, the movable mounting means in this case comprises clip 22, joining member 20, 'T' piece 18, and sections of corrugated hose 17, and incorporates the laser spinner 21. Said movable mounting means facilitates free movement of the vacuum head, as shown in FIG. 4(*b*), relative to the guide means, comprising the guide rail 23. It should be noted that, whilst the illustrated embodiment shows a multiplicity of holes 16, embodiments comprising, for example, a single extended slit would also fall within the scope of the invention.

Optionally, the present invention allows for the incorporation of more than one cyclone device in the extraction device in order to improve the efficiency of ablation debris collection. Subsequent cyclones would be connected in series to the first cyclone.

The efficiency of the apparatus and method of the present invention was investigated by exposing a Silverlith® SDT printing plate precursor, supplied by Agfa-Gevaert Limited, by means of a Gerber C42T platesetter. The associated debris, generated by ablation of the imaging layer on exposure and observed by means of high resolution SEM microscopy, consisted primarily of silver particles having a particle size in the range of from 0.1 to 1.0 $\mu$m, together with a small fraction of particles having a particle size in the region of 10 nm. The said debris was collected by means of extraction apparatus according to the present invention, as shown in FIG. 1, equipped with a cyclone, HEPA filter and an absorbent filter. The extent of silver removal which can be achieved was measured using apparatus incorporating either a reverse flow gas cyclone or a uniflow gas cyclone, together with various different absorbent materials in the absorbent filter, and the results are illustrated by the data of Table 1. It should be noted that the cyclones utilised for these experiments represent different embodiments to those illustrated in FIGS. 2 and 3.

TABLE 1

Proportion of ablated silver debris collected on various components of the extraction system

| Extraction System Element | % (w/w) Ablated Silver found on each Element of Extraction System for different types of Apparatus | | |
|---|---|---|---|
| | No Cyclone | Reverse Flow Gas Cyclone | Uniflow Gas Cyclone |
| Vacuum Head | 15 | 13 | 14 |
| Cyclone | — | 69 | 63 |
| First 1.5 m of Duct | 46 | 0 | 5 |
| HEPA Filter | 24 | 18 | 18 |
| Unaccounted | 15 | 0 | 0 |

Dimensions of Reverse Flow Gas Cyclone: A=135 mm; B=30 mm; C=105 mm; D=35 mm; E=15 mm; F=19 mm; G=8 mm; H=22 mm; I=13 mm.

Dimensions of Uniflow Gas Cyclone: A=85 mm; B=75 mm; C=10 mm; D=39 mm; E=19 mm; F=5 mm; G=5 mm; H=20 mm; I=20 mm.

Thus, it is seen that the bulk of the silver ablation debris is collected in the cyclone and the amount deposited in the ductwork leading from the vacuum head to the HEPA filter is significantly reduced. Clearly, this will have a significant beneficial effect in reducing the necessity for cleaning of the internal surfaces of the ducting.

The relative efficiency of several materials as constituents of the absorbent filter, for effecting the removal of submicron silver particles, was evaluated by measuring the extent of silver emissions to the atmosphere and assessing the odour of the emitted airstream. The effectiveness of the various absorbents may be gleaned from the following details:

TABLE 2

Effectiveness of absorbent materials in the removal of submicron silver particles from ablated airstream

| Absorbent Material | Size (mm) | Removal of Odour | Silver Emissions in Environment ($mg/m^3$) |
|---|---|---|---|
| None | — | No | 0.0057 |
| Silica Gel (Internal Surface Area 500–800 $m^2/g$) | 3–6 | Yes | <0.0013 |
| Molecular Sieve UOP Type 4A (Sodium Potassium Silicate) | 2.4–4.8 | Yes | <0.0013 |
| Activated Charcoal | 4.8 | Yes | <0.0013 |
| Glass Beads | 4 | No | 0.0054 |

The occupational health limit for airborne silver particulates and soluble compounds (as defined by the US OSHA (Occupational Safety and Health Administration) using Method 121) is 0.01 $mg/m^3$ for an 8 hour day. It can be seen, therefore, that silica gel, activated charcoal and the specified molecular sieve, which are more usually employed for the removal of gaseous materials from an airstream, all perform to a similar level in this case, and are very effective in achieving the removal of submicron silver particles from the waste gas stream.

We claim:

1. An apparatus for collecting ablated material generated by exposure of an imaging layer to a source of radiation, said apparatus comprising a vacuum supply means, and a vacuum head connected to, and in close proximity with, a centrifugal separator, said vacuum head being for direct attachment to a movable mounting means having guide means.

2. An apparatus as defined in claim 1 wherein said centrifugal separator comprises a gas-solid separator using centrifugal forces to separate solid particles from transport gas.

3. An apparatus as defined in claim 2 wherein non-stick coatings are applied to all internal surfaces.

4. An apparatus as defined in claim 1 wherein non-stick coatings are applied to all internal surfaces.

5. An apparatus as defined in claim 1 wherein said movable mounting means additionally supports the radiation source utilised for imaging the imaging member.

6. An apparatus as defined in claim 1 which additionally comprises a filtration system capable of removing any remaining toxic materials or other contaminants at least to the extent that said materials in the gas flow are reduced to a level below occupational health limits.

7. An apparatus as defined in claim 6 wherein said filtration system additionally comprises an absorbent filter, capable of removing residual odours and very fine particles from the exhaust gases.

8. An apparatus as defined in claim 1 which additionally comprises a baffle arrangement located between the vacuum head and the centrifugal separator.

* * * * *